US009032848B2

(12) United States Patent
Hsieh

(10) Patent No.: US 9,032,848 B2
(45) Date of Patent: May 19, 2015

(54) TORQUE WRENCH AND METHOD OF OPERATING THE SAME

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 252 days.

(21) Appl. No.: 13/705,150

(22) Filed: Dec. 4, 2012

(65) Prior Publication Data

US 2014/0068909 A1 Mar. 13, 2014

(30) Foreign Application Priority Data

Sep. 10, 2012 (TW) ..... 101133020 A

(51) Int. Cl.
*B25B 23/142* (2006.01)

(52) U.S. Cl.
CPC ..... *B25B 23/1427* (2013.01); *Y10T 29/49766* (2015.01); *B25B 23/142* (2013.01)

(58) Field of Classification Search
CPC .. B25B 23/14; B25B 23/142; B25B 23/1427; B25B 23/16; B25G 1/043; Y10T 29/49766
USPC ..... 81/467, 478, 483, 177.2, 177.85
See application file for complete search history.

(56) References Cited

U.S. PATENT DOCUMENTS

| | | | | |
|---|---|---|---|---|
| 4,403,531 | A * | 9/1983 | Bailey et al. | 81/483 |
| 5,129,293 | A * | 7/1992 | Larson et al. | 81/483 |
| 5,911,801 | A * | 6/1999 | Fravalo et al. | 81/478 |
| 7,392,711 | B2 * | 7/2008 | Hsieh | 73/862.21 |
| 7,469,619 | B2 * | 12/2008 | Anjanappa et al. | 81/479 |
| 8,561,505 | B2 * | 10/2013 | Richardson | 81/177.2 |
| 8,667,870 | B2 * | 3/2014 | Teper | 81/177.2 |
| 2013/0145908 | A1 * | 6/2013 | Lee et al. | 81/177.85 |
| 2014/0069243 | A1 * | 3/2014 | Hsieh | 81/478 |

* cited by examiner

*Primary Examiner* — Hadi Shakeri
(74) *Attorney, Agent, or Firm* — CKC & Partners Co., Ltd.

(57) ABSTRACT

A torque wrench includes a hollow body, a clutch mechanism, a force-applying member, and driving arms. The clutch mechanism is mounted in the hollow body. The force-applying member is pivotally mounted in the hollow body. Each of driving arms has a coupling end is detachably mounted at the second end of the force-applying member and a driving end for driving a workpiece, wherein each of the driving arms is coaxial to the force-applying member when the coupling end thereof is mounted at the second end of the force-applying member, and wherein the interchangeable driving arms are different in length from each other.

9 Claims, 12 Drawing Sheets

TORQUE WRENCH AND METHOD OF OPERATING THE SAME

RELATED APPLICATIONS

The application claims priority to Taiwan Application Serial Number 101133020, filed Sep. 10, 2012, which is herein incorporated by reference.

BACKGROUND

1. Field of Invention

The present disclosure relates to a wrench. More particularly, the present disclosure relates to a torque wrench and a method of operating the torque wrench.

2. Description of Related Art

Click-type torque wrenches are well-known and maturely commercialized products. Typically, a click-type torque includes a mechanism providing an audible "click" or a movement giving "feel" to the operator when the predetermined torque has been reached so that the operator is prevented from applying a greater torque than intended and fasteners will not be damaged or destroyed. Therefore, the click-type torque wrenches are popular in the high-precision industry.

In the field of large-scale machinery involving aircraft, cruise ship, and the like, click-type torque wrenches are required for routine maintenances or assembling during the manufacture. However, commercialized click-type torque wrenches for the machinery are hard for the storage due to big size, typically being a dimension of about 1 m to 2 m.

In dealing with the large-scale machinery installed with various specifications of nuts (for example, size of ¼", ⅜", ½", ¾", or 1", etc.), a kit of sockets and a kit of click-type torque in various dimensions are required, which is costly and space-ineffective. However, none of the known click-type torque wrenches is dismountable because of a rather complex mechanism thereof.

SUMMARY

According to the first aspect of the present disclosure, a torque wrench includes a hollow body, a clutch mechanism, a force-applying member, and a driving arm. The clutch mechanism is mounted in the hollow body. The force-applying member is pivotally mounted in the hollow body. The force-applying member has a first end against the clutch mechanism and a second end opposing to the first end. The driving arm has a coupling end and a driving end. The coupling end is detachably mounted at the second end of the force-applying member, the driving end is used for driving a workpiece, and the driving arm is coaxial to the force-applying member.

According to the second aspect of the present disclosure, a method of operating the torque wrench includes the following steps. The clutch mechanism and the force-applying member are mounted in the hollow body. The driving arm is mounted at the second end of the force-applying member and is coaxial to the force-applying member. The overall length of the force-applying member and the driving arm is taken as a first moment arm to drive the workpiece.

According to the third aspect of the present disclosure, a torque wrench includes a hollow body, a clutch mechanism, a force-applying member, and a driving arm. The hollow body has a handle and an elongate sleeve. The elongate sleeve is engaged into the handle and has a first scale and a second scale thereon. The clutch mechanism is mounted in the hollow body and held by the handle and the elongate sleeve. The force-applying member is pivotally mounted in the hollow body. The force-applying member has a first end against the clutch mechanism and a second end opposing to the first end. A first torque conducted by the second end of the force-applying member corresponds to the first scale. The driving arm has a coupling end and a driving end. The coupling end is detachably mounted at the second end of the force-applying member and the driving end is used for driving a workpiece under a second torque corresponding to the second scale.

According to the fourth aspect of the present disclosure, a method of operating the torque wrench includes the following steps. The handle and the elongate sleeve are calibrated with the first scale. The length of the force-applying member is taken as a second moment arm to drive the workpiece. The driving arm is mounted at the second end of the force-applying member and is coaxial to the force-applying member. The handle and the elongate sleeve are calibrated with the second scale. The overall length of the force-applying member and the driving arm is taken as a first moment arm to drive the workpiece.

According to the fifth aspect of the present disclosure, a torque wrench for holding a socket includes a hollow body, a clutch mechanism, a force-applying member, and a driving arm. The clutch mechanism is mounted in the hollow body. The force-applying member is pivotally mounted in the hollow body. The force-applying member has a first end against the clutch mechanism and a second end opposing to the first end. The driving arm has a coupling end and a driving end. The coupling end is detachably mounted at the second end of the force-applying member, the driving end is used for holding the socket, and the driving arm is coaxial to the force-applying member.

According to the sixth aspect of the present disclosure, a method of operating the torque wrench includes the following steps. The clutch mechanism and the force-applying member are mounted in the hollow body. The driving unit is mounted at the second end of the force-applying member. The length of the force-applying member is taken as a second moment arm. The driving arm is mounted at the driving unit and is coaxial to the force-applying member. The overall length of the force-applying member, the driving unit, and the driving arm is taken as a third moment arm to drive the workpiece.

According to the seventh aspect of the present disclosure, a torque wrench for holding a socket includes a hollow body, a clutch mechanism, a force-applying member, a driving unit, a driving arm, and a driving head. The hollow body has a handle and an elongate sleeve. The elongate sleeve is engaged into the handle and has a first scale and a second scale thereon. The clutch mechanism is mounted in the hollow body and held by the handle and the elongate sleeve. The force-applying member is pivotally mounted in the hollow body. The force-applying member has a first end against the clutch mechanism and a second end opposing to the first end. A torque conducted by the second end of the force-applying member corresponds to the first scale. The driving unit is detachably mounted at the second end of the force-applying member. The driving unit is used for driving a first workpiece with a first size. The driving arm has a coupling end and a driving end. The coupling end is detachably mounted at the second end of the force-applying member, and the driving arm is coaxial to the force-applying member. The driving head is detachably mounted at the driving end of the driving arm. The driving head is used for driving a second workpiece with a second size different from the first size.

BRIEF DESCRIPTION OF THE DRAWINGS

The disclosure can be more fully understood by reading the following detailed description of the embodiment, with reference made to the accompanying drawings as follows.

DETAILED DESCRIPTION

The 1st Embodiment

Figure 1:
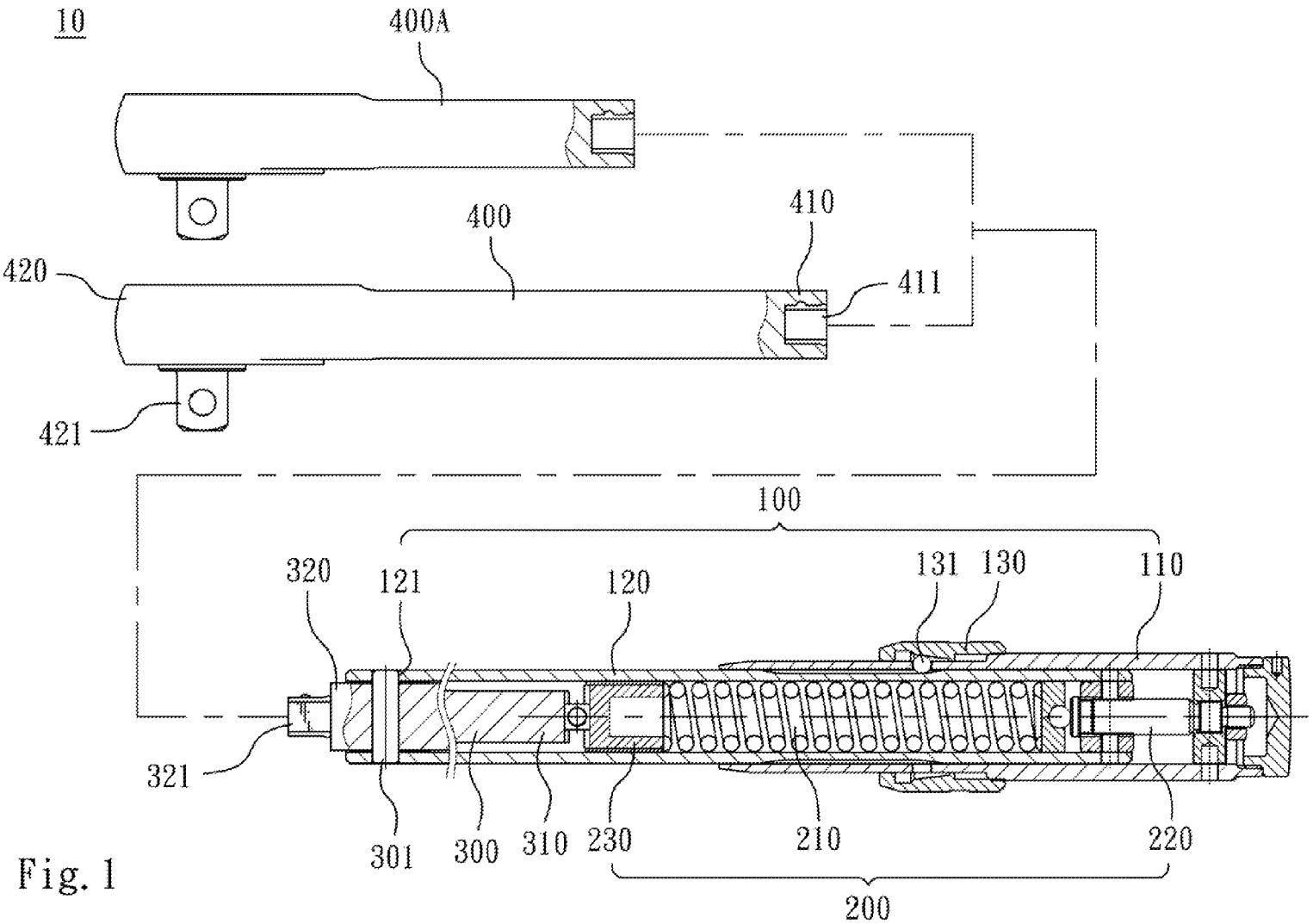
FIG. 1 is a sectional exploded schematic view of a torque wrench according to the first embodiment of the present disclosure.
Figure 2:
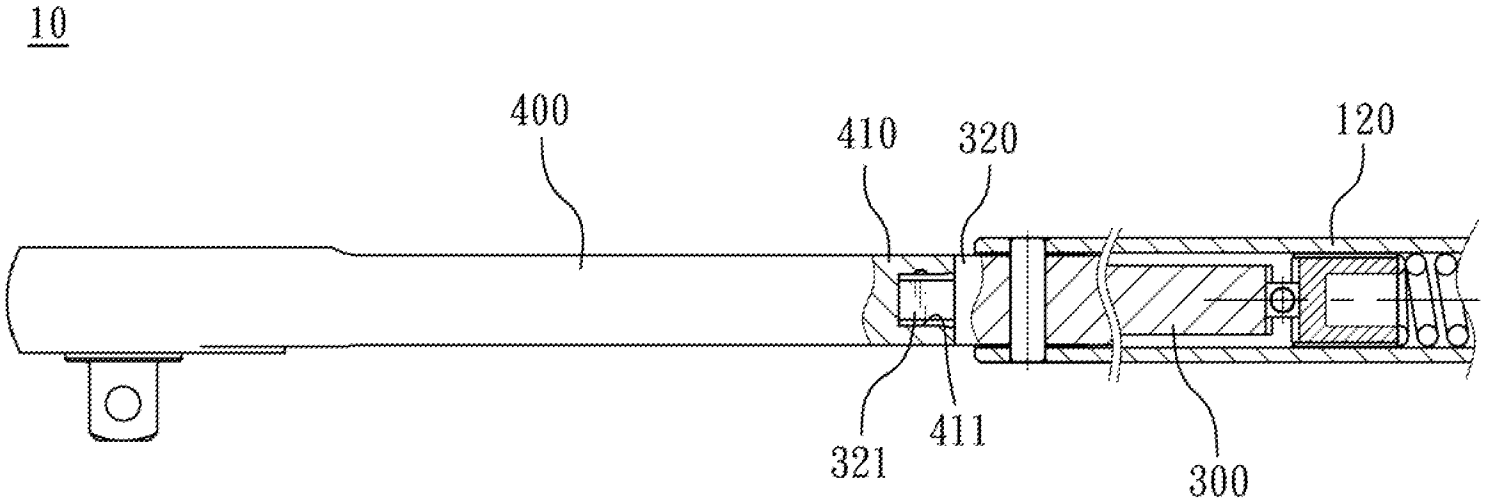
FIG. 2 is a schematic view of the torque wrench of FIG. 1 after mounted.

FIG. 1 is a sectional exploded schematic view of a torque wrench according to the first embodiment of the present disclosure. FIG. 2 is a schematic view of the torque wrench of FIG. 1 after mounted. Referring to FIG. 1 and FIG. 2, the torque wrench 10 includes a hollow body 100, a clutch mechanism 200, a force-applying member 300, a first driving arm 400, and a second driving arm 400A. The first driving arm 400 is longer than the second driving arm 400A. In fact, the torque wrench 10 may further include other driving arms as needed and the length of each differs from that of others. Or, the torque wrench 10 may include another driving arm which is a plurality of rods detachably assembled with each other.

The hollow body 100 includes a handle 110, an elongate sleeve 120, and a lock sleeve 130. The elongate sleeve 120 is engaged into the handle 110 and can be rotated within the handle 110. The lock sleeve 130 is arranged around the handle 110 and the rotation of the elongate sleeve 120 within the handle 110 is allowed or prohibited by a lock mechanism configured of the lock sleeve 130 and a ball 131. The elongate sleeve 120 has a hole 121 therethrough.

The clutch mechanism 200 is mounted in the handle 110. The force-applying member 300 is pivotally mounted at the hole 121 of the elongate sleeve 120 by a pivot pin 301 and against the clutch mechanism 200. The clutch mechanism 200 has a spring 210, a load screw 220, and a plunger 230. The force-applying member 300 has a first end 310 and a second end 320 opposing to the first end 310 and having a first mounted portion 321. The first mounted portion 321 is convex. The pivot pin 301 is arranged between the first end 310 and the second end 320. The load screw 220 connects the handle 110 and be driven by the handle 110. The spring 210 is compressed by the load screw 220 and against the plunger 230. The plunger 230 is pushed by the spring 210 and abutted against the first end 310 of the force-applying member 300. When a predetermined torque has been reached, the first end 310 of the force-applying member 300 hits the inner wall of the hollow body 100 and the torque wrench 10 will provide an audible "click" to the operator so that preventing greater torque and damage of a workpiece such as a fastener, a bolt, a nut, or the like.

The first driving arm 400 has a coupling end 410 and a driving end 420. The coupling end 410 has a second mounted portion 411 which is concave. The second mounted portion 411 can be detachably mounted at the first mounted portion 321 such as bolted or engaged together. In addition, the driving end 420 has a fixed lateral drive extension 421 which can hold a socket (not shown) for driving a workpiece (not shown). After mounted, the first driving arm 400 is coaxial to the force-applying member 300. Thus, the torque wrench 10 can take the overall length of the force-applying member 300 and the first driving arm 400 as a first moment arm to drive the workpiece.

The second driving arm 400A is the same as the first driving arm 400, except for the length. The first driving arm 400 mounted at the first mounted portion 321 of the force-applying member 300 can be changed to the second driving arm 400A as needed and then brings the torque wrench 10 a shorter moment arm. Additionally, changing the first driving arm 400 to the second driving arm 400A is easily obtained because the clutch mechanism 200 is mounted in the hollow body 100 that won't affect the changing.

The fixed lateral drive extension 421 of the driving end 420 may be changed to a driving unit (not shown) that the second driving arm 400A can be mounted at coaxially while a socket can be hold perpendicularly. Thus, the torque wrench 10 can take a longer length as a moment arm to drive the workpiece. The concept of changing the fixed lateral drive extension 421 to the driving unit is also applied to the second driving arm 400A. Dismounted driving arms (such as the first driving arm 400 and the second driving arm 400A) make the torque wrench 10 easy to storage and flexible in determining the moment arm. It is cost-effective and space-effective because the operator does not need to prepare a kit of torque wrenches and larger space for storage them as before.

The 2nd Embodiment

Figure 3:
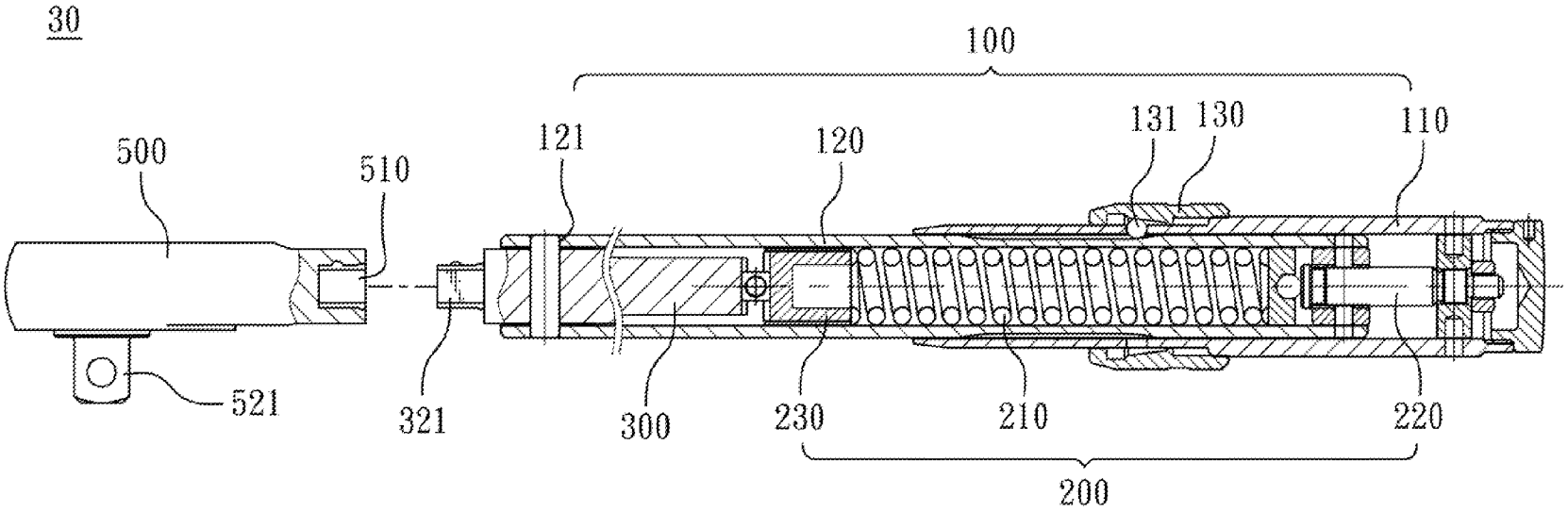
FIG. 3 is a sectional exploded schematic view of a torque wrench according to the second embodiment of the present disclosure.
Figure 4:
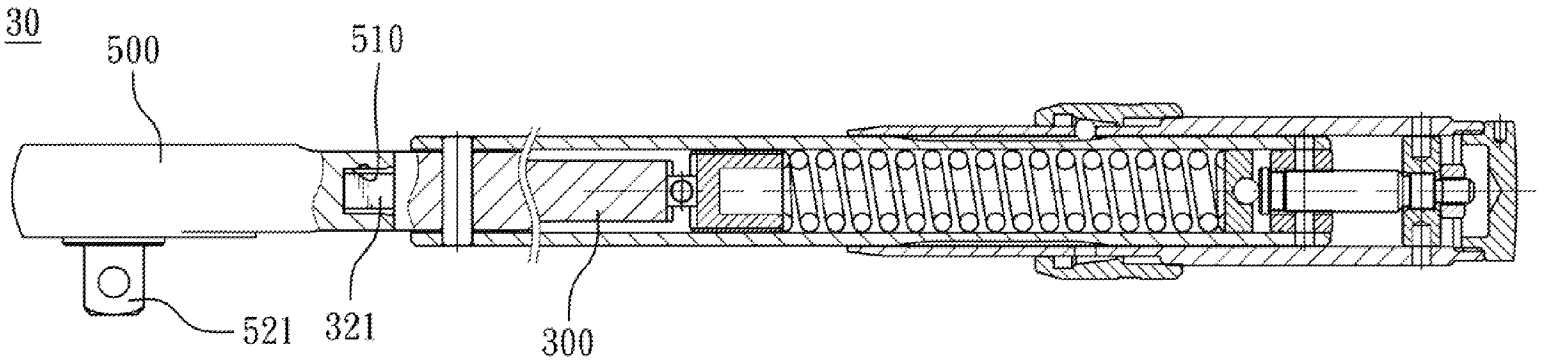
FIG. 4 is a schematic view of the torque wrench of FIG. 3 after mounted.

FIG. 3 is a sectional exploded schematic view of a torque wrench according to the second embodiment of the present disclosure. FIG. 4 is a schematic view of the torque wrench of FIG. 3 after mounted. Referring to FIG. 3 and FIG. 4, the torque wrench 30 includes the hollow body 100, the clutch mechanism 200, the force-applying member 300, and a third driving arm 500. In fact, the torque wrench 30 may further includes the first driving arm 400 (not shown), and the second driving arm 400A (not shown) for mounted. Except for the third driving arm 500, elements and connections therebetween of this embodiment are the same as those described in the first embodiment.

The third driving arm 500 has a fixed lateral drive extension 521 for holding a socket (not shown) to drive a workpiece. The third driving arm 500 has a third mounted portion 510 which is concave and perpendicular to the fixed lateral drive extension 521. The third mounted portion 510 is formed at one end of the third driving arm 500 and can be detachably mounted at the first mounted portion 321 of the force-applying member 300. After mounted, the driving arm 500 is coaxial to the force-applying member 300. Thus, the torque wrench 30 can take the overall length of the force-applying member 300 and the third driving arm 500 mounted as a first moment arm to drive the workpiece. The third driving arm 500 is dismountable that makes the torque wrench 30 easy to storage and flexible in determining moment arm as needed (as long as changing the third driving arm 500 to another driving arm).

Figure 5:
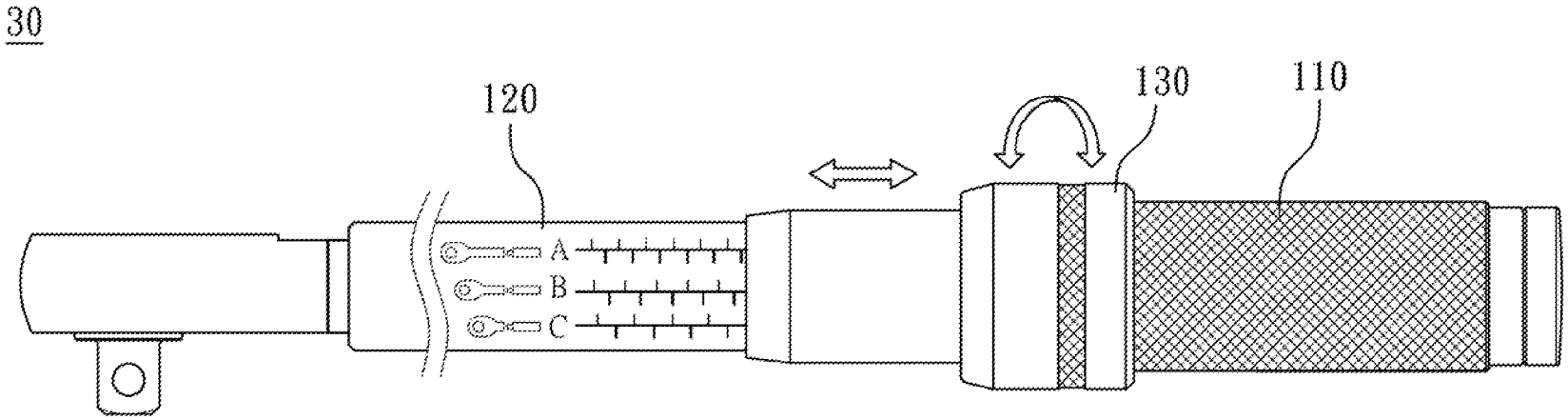
FIG. 5 is an external view of the torque wrench of FIG. 4.

FIG. 5 is an external view of the torque wrench of FIG. 4. Referring to the FIG. 5, the elongate sleeve 120 has a first scale A, a second scale B, and a third scale C thereon that respectively indicate a torque to be conducted by the first driving arm 400, the second driving arm 400A, and the third driving arm 500 after mounted at the force-applying member 300. For example, a torque of the torque wrench 30 for driving the workpiece can be predetermined and conducted corresponding to the third scale C when the third driving arm 500 is mounted and used, and another torque of the torque wrench 30 for driving the workpiece can be predetermined and conducted corresponding to the first scale A when the first driving arm 400 is mounted and used.

Figure 6:
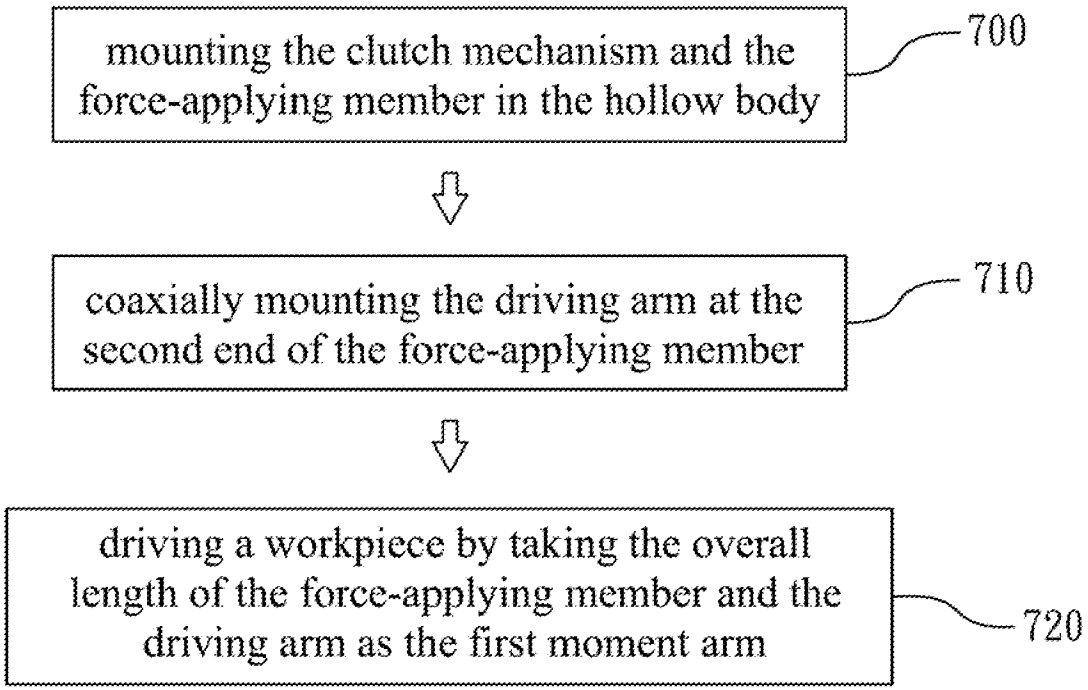
FIG. 6 is a flowchart illustrating a method of operating the torque wrench of the second embodiment.

FIG. 6 is a flowchart illustrating a method of operating the torque wrench of the second embodiment. Be noted that the method is also applied to the first embodiment. Referring to FIG. 6, a method of operating the torque wrench includes the following steps. In step 700, the clutch mechanism 200 and the force-applying member 300 are mounted in the hollow body 100. In step 710, one of the first driving arm 400, the second driving arm 400A, and the third driving arm 500 is coaxially mounted at the second end 320 of the force-applying member 300. In step 720, the torque wrench 30 takes the overall length of the force-applying member 300 and one of the driving arms as the first moment arm to drive the workpiece.

The 3rd Embodiment

Figure 7:
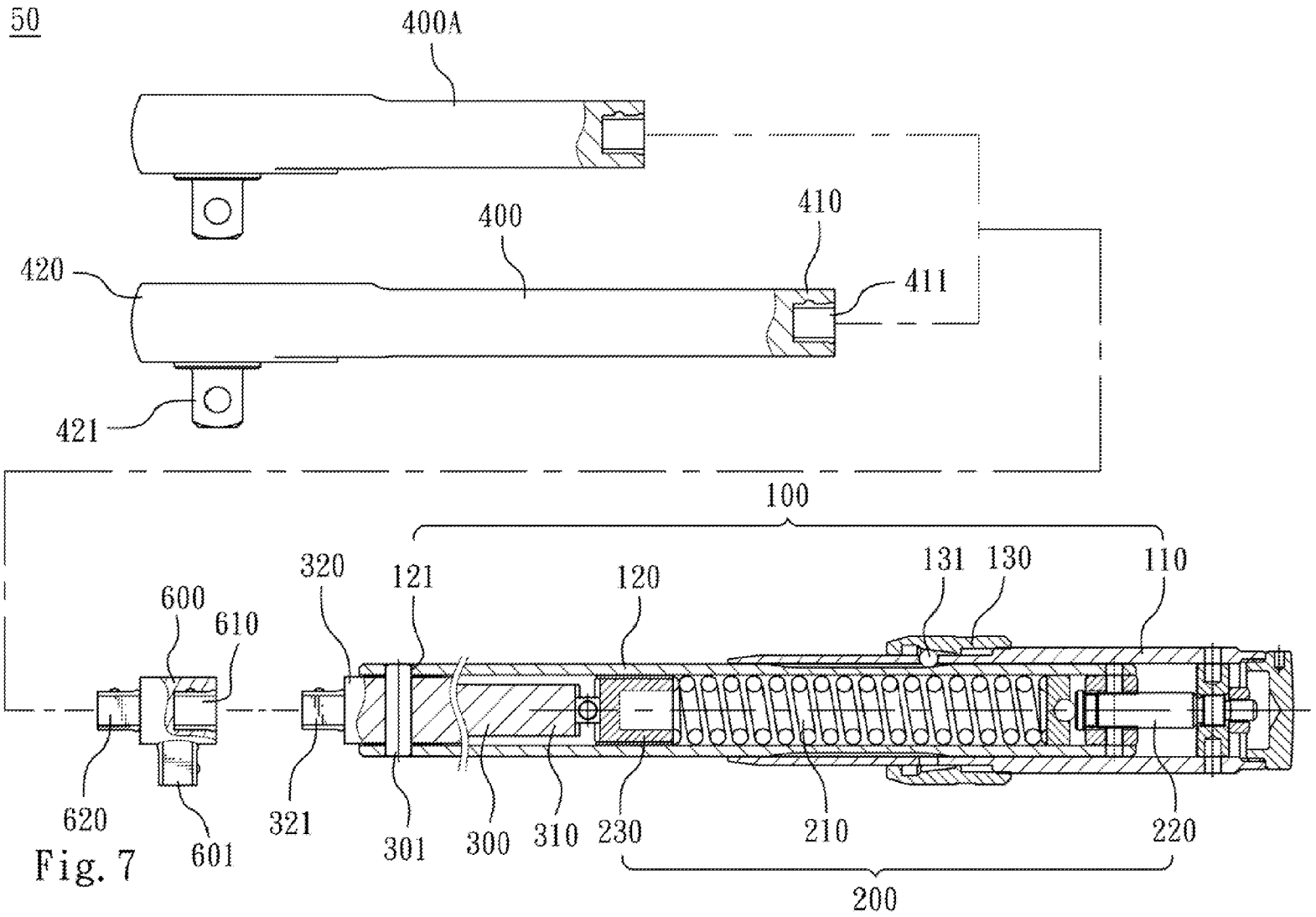
FIG. 7 is a sectional exploded schematic view of a torque wrench for holding a socket according to the third embodiment of the present disclosure.
Figure 8:
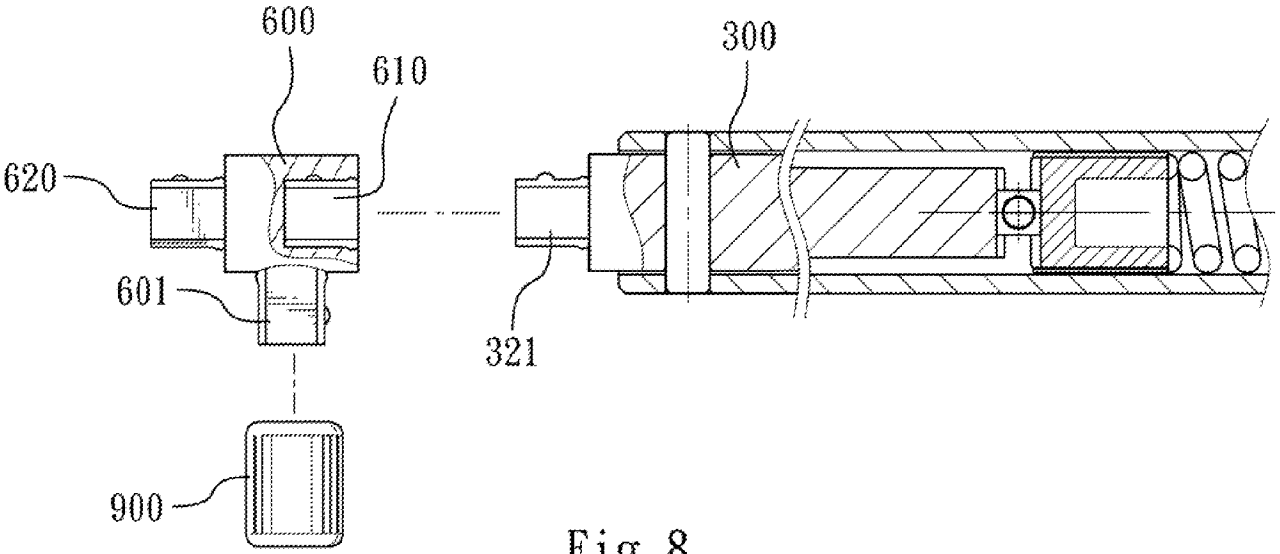
FIG. 8 is a partial view of the torque wrench of FIG. 7.
Figure 9:
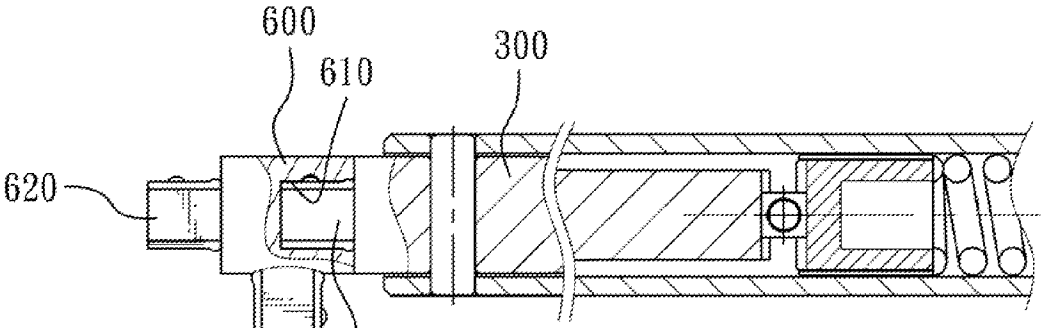
FIG. 9 is a partial view of the torque wrench of FIG. 7 after mounted.
Figure 10:
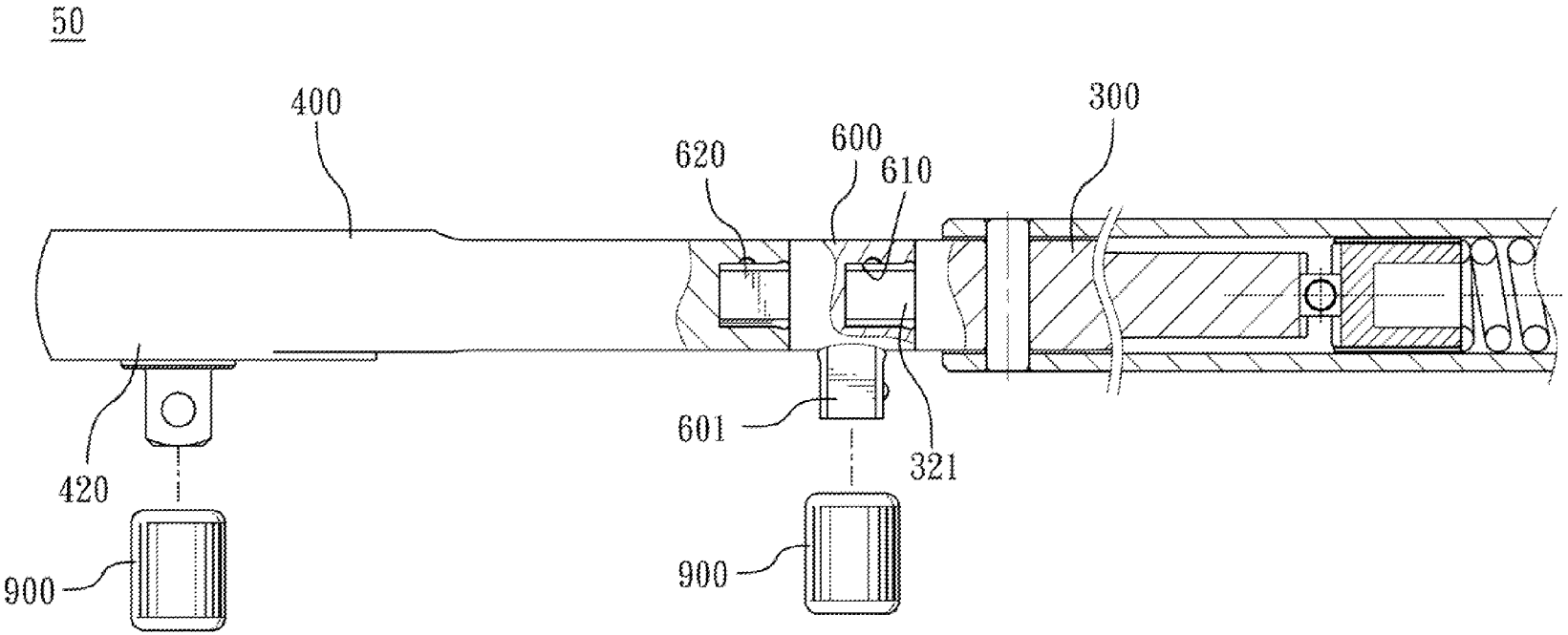
FIG. 10 is a schematic view of the torque wrench of FIG. 7 after mounted.

FIG. 7 is a sectional exploded schematic view of a torque wrench for holding a socket according to the third embodiment of the present disclosure. FIG. 8 is a partial view of the torque wrench of FIG. 7, FIG. 9 is a partial view of the torque wrench of FIG. 7 after mounted, and FIG. 10 is a schematic view of the torque wrench of FIG. 7 after mounted. Referring to FIGS. 7-10, the torque wrench 50 for holding a socket includes the hollow body 100, the clutch mechanism 200, the force-applying member 300, the first driving arm 400, the second driving arm 400A, a driving unit 600, and two sockets 900. Except for the driving unit 600 and the sockets 900, elements and connections therebetween of this embodiment are the same as those described in the first embodiment of the present disclosure.

The driving unit 600 has a fourth mounted portion 610 which is concave and a fifth mounted portion 620 which is convex and coaxial to the fourth mounted portion 610. The fourth mounted portion 610 of the driving unit 600 can be detachably mounted at the first mounted portion 321 of the force-applying member 300. After mounted, the driving unit 600 is coaxial to the force-applying member 300 and the torque wrench 50 can take the length of the force-applying member 300 as a second moment arm to drive a workpiece. The second mounted portion 411 of the first driving arm 400 can be detachably mounted at the fifth mounted portion 620. After mounted, the first driving arm 400, the force-applying member 300, and the driving unit 600 are coaxial to each other. Thus, the torque wrench 50 can take the overall length of the force-applying member 300, the driving unit 600, and the first driving arm 400 as a third moment arm to driving the workpiece.

In order to drive the workpiece, one of the sockets 900 can be holed at the fixed lateral drive extension 421 of the first driving arm 400 or at a lateral drive extension 601 of the driving unit 600. The torque wrench 50 can provide an audible "click" to the operator when the predetermined torque has been reached whether the socket 900 is holed at the driving arm 400 or at the driving unit 600. That is to say, the torque wrench 50 provides two moment arms for the operator to choose to drive the workpiece that makes driving the workpiece become easier and faster. All the driving arms are dismountable makes the torque wrench 50 easy to storage and flexible in determining a moment arm.

Be noted that the first driving arm 400 mounted at the fifth mounted portion 620 may be changed to the second driving arm 400A, and the first driving arm 400 or the second driving arm 400A may be directly mounted at the first mounted portion 321 of the force-applying member 300 without the driving unit 600 in this embodiment. Additionally, the fixed lateral drive extension 421 of the driving end 420 may be changed to another driving unit 600. Then the second driving arm 400A can be coaxially mounted at the fifth mounted portion 620 of another driving unit 600 and a socket can be hold at the lateral drive extension 601 of another driving unit 600 to drive the workpiece.

Figure 11:
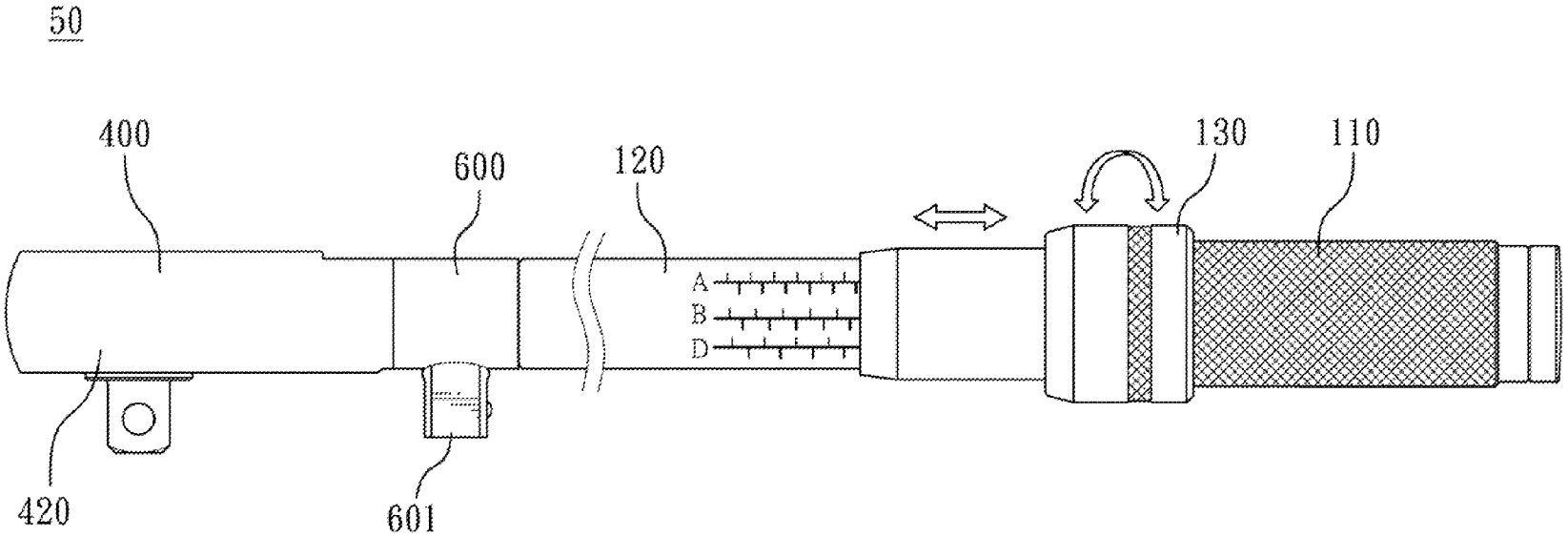
FIG. 11 is an external view of the torque wrench of FIG. 10.

FIG. 11 is an external view of the torque wrench of FIG. 10. Referring to FIG. 11, the elongate sleeve 120 has a first scale A, a second scale B, and a fourth scale D thereon that respectively indicate torque to be conducted by the first driving arm 400, the second driving arm 400A, and the driving unit 600 after mounted at the force-applying member 300. For example, the workpiece can be driven by the torque wrench 50 under a torque corresponding to the fourth scale D when the driving unit 600 is mounted and used, and the workpiece can be driven by the torque wrench 50 under another torque corresponding to the fourth scale B when the second driving arm 400A is mounted and used.

When the operator drives the workpiece by a socket held at the lateral drive extension 601 of the driving unit 600 of the torque wrench 50, a predetermined torque of the torque wrench 50 triggering an audible "click" corresponds to the fourth scale D. It means that the predetermined torque of the torque wrench 50 conducted by the second end 320 of the force-applying member 300 corresponds to the fourth scale D. Similarly, another torque of the torque wrench 50 conducted by the fixed lateral drive extension 421 of the first driving arm 400 coaxially mounted with the force-applying member 300 corresponds to the first scale A. Thus, the torque of the torque wrench 50 can be predetermined and conducted depends on the mounted driving arm. Be noted that the elongate sleeve 120 may has another scale thereon, for example, a fifth scale E (not shown), to indicate torque to be conducted by a combination of the first driving arm 400 and the driving unit 600 or a combination of the second driving arm 400A and the driving unit 600.

Figure 12:
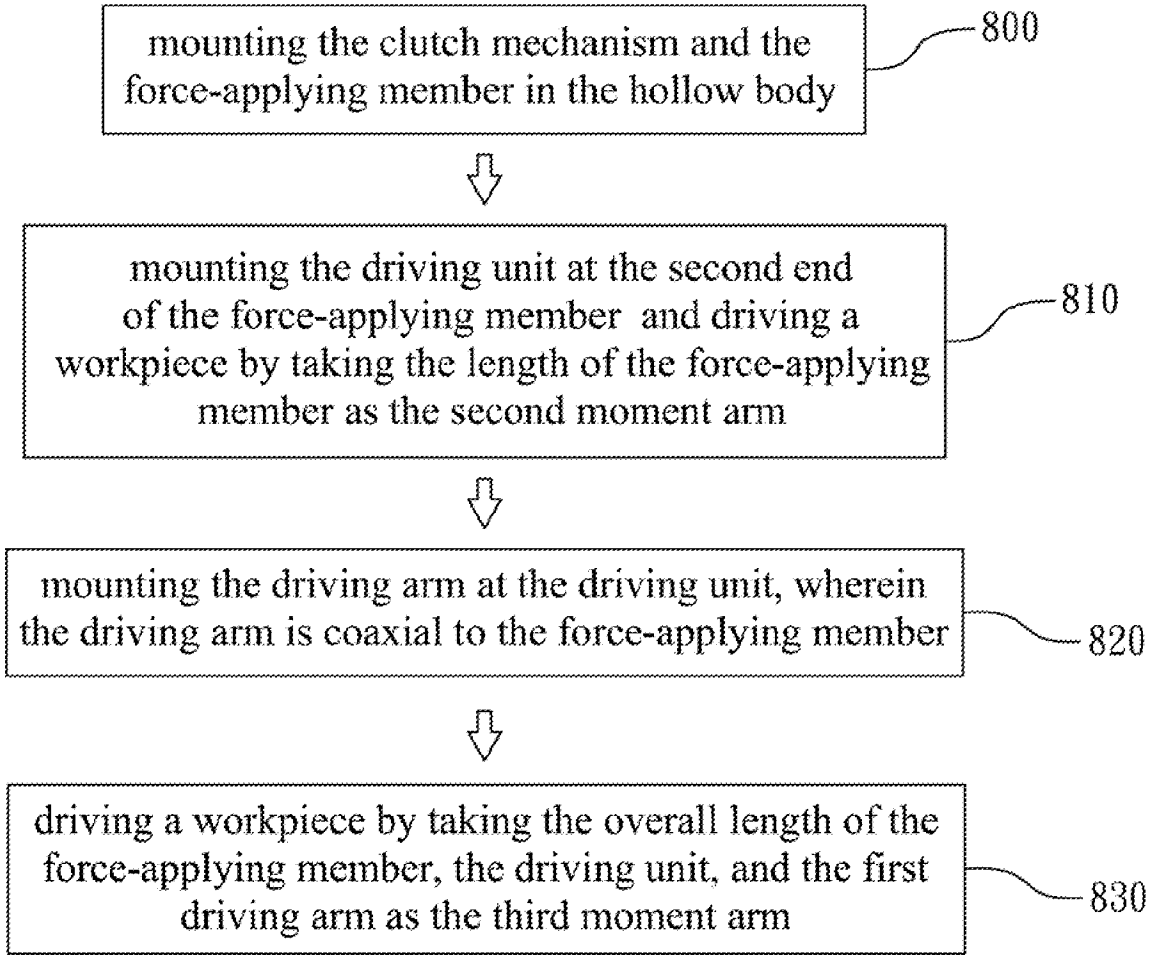
FIG. 12 is a flowchart illustrating a method of operating the torque wrench according to the third embodiment of the present disclosure.

FIG. 12 is a flowchart illustrating a method of operating the torque wrench of the third embodiment. Referring to FIG. 12, a method of operating the torque wrench includes the following steps. In step 800, the clutch mechanism 200 and the force-applying member 300 are mounted in the hollow body 100. In step 810, the driving unit 600 is mounted at the second end 320 of the force-applying member 300 and the torque wrench 50 takes the length of the force-applying member 300 as the second moment arm to drive the workpiece. In step 820, the first driving arm 400 is mounted at the driving unit 600 and coaxial to the force-applying member 300. In step 830, the torque wrench 50 takes the overall length of the force-applying member 300, the driving unit 600, and the first driving arm 400 as the third moment arm to drive the workpiece.

For example, the operator can calibrate the handle 110 and the elongate sleeve 120 with the fourth scale D first and then takes the length of the force-applying member 300 as the second moment arm to drive the workpiece by the socket 900 held at the lateral drive extension 601 of the driving unit 600. Next, the operator can further coaxially mount the first driving arm 400 at the fifth mounted portion 620 of the driving unit 600 and calibrate the handle 110 and the elongate sleeve 120 with the fifth scale E. Then, the operator an take the overall length of the force-applying member 300, the driving unit 600, and the driving arm 400 as the third moment arm to drive the workpiece by the socket 900 held at the lateral drive extension 421 of the driving arm 400.

The 4$^{th}$ Embodiment

Figure 13:
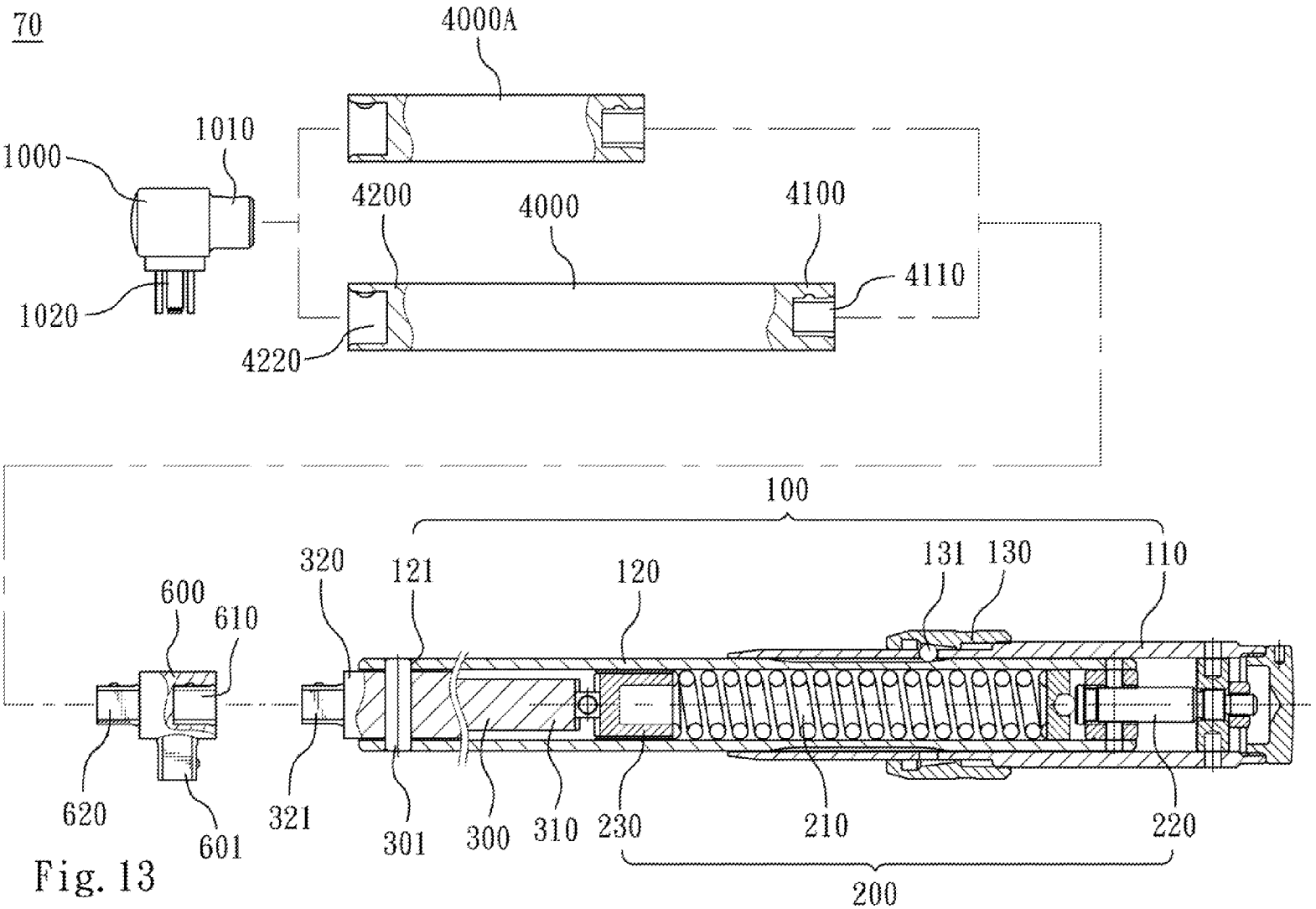
FIG. 13 is a sectional exploded schematic view of a torque wrench according to the fourth embodiment of the present disclosure.
Figure 14:
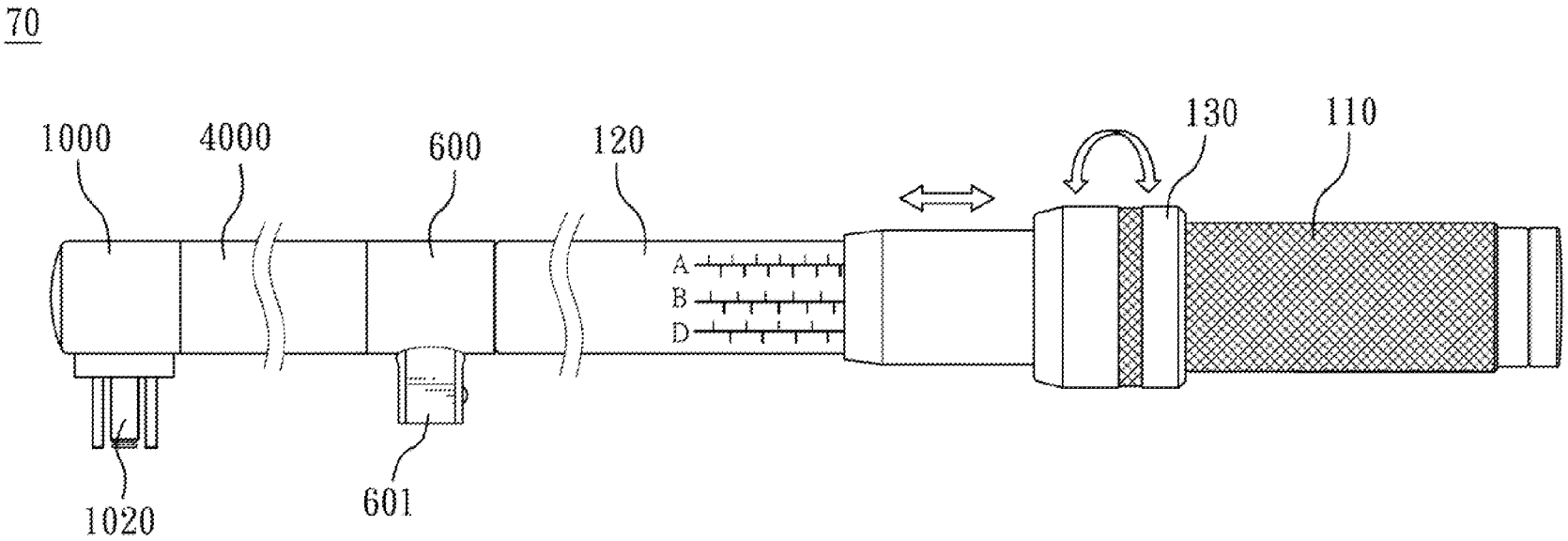
FIG. 14 is an external view of the torque wrench of FIG. 13.

FIG. 13 is a sectional exploded schematic view of a torque wrench according to the fourth embodiment of the present disclosure. FIG. 14 is an external view of the torque wrench of FIG. 13. Referring to FIG. 13 and FIG. 14, the torque wrench 70 includes the hollow body 100, the clutch mechanism 200, the force-applying member 300, the driving unit 600, a first driving arm 4000, a second driving arm 4000A, and a driving head 1000. Except for the first driving arm 4000, a second driving arm 4000A, and a driving head 1000, elements and connections therebetween of this embodiment are the same as those described in the third embodiment of the present disclosure.

The first driving arm 4000 has a coupling end 4100 and a driving end 4200. The coupling end 4100 has a second mounted portion 4110 which is concave. The driving end 4200 has a sixth mounted portion 4220 which is concave and coaxial to the second mounted portion 4110. The second mounted portion 4110 of the driving arm 4000 can be detachably mounted at the fifth mounted portion 620 of the driving unit 600. After mounted, the force-applying member 300, the driving unit 600, and the first driving arm 4000 are coaxial to each other.

The driving head 1000 is configured for holding a socket. The driving head 1000 has a seventh mounted portion 1010 which is convex and a lateral joint portion 1020 which is perpendicular to the seventh mounted portion 1010. The seventh mounted portion 1010 of the driving head 1000 can be detachably mounted at the sixth mounted portion 4220 of the driving end 4200 of the first driving arm 4000, and the lateral joint portion 1020 of the driving head 1000 can be used to hold the socket for driving the workpiece.

The second driving arm 4000A is the same as the first driving arm 4000, except for the length. The first driving arm 4000 mounted at the fifth mounted portion 620 of the driving unit 600 can be changed to the second driving arm 4000A as needed and then brings the torque wrench 70 a shorter moment arm. Additionally, changing the first driving arm 4000 to the second driving arm 4000A is easily obtained because the clutch mechanism 200 is mounted in the hollow body 100 that won't affect the changing.

In this embodiment, the torque wrench 70 takes the overall length of the force-applying member 300, the driving unit 600, the first driving arm 4000, and the driving head 1000 as a fourth moment arm to drive the workpiece. Be noted that the torque wrench 70 can choose the driving unit 600, the driving head 1000, or the both to mount for holding a socket to drive the workpiece. Thus, the torque wrench 70 provides two moment arms for the operator to drive the workpiece that makes driving the workpiece become easier, faster and flexible in determining a moment arm. All the driving arms are dismountable also makes the torque wrench 70 easy to storage.

Furthermore, the driving unit 600 and the driving head 1000 mounted on the torque wrench 70 may hold sockets with different specs. For example, the driving unit 600 is used to hold a ¼" socket and the driving head 1000 is used to hold a ⅜" socket, and the contrary is also applied. Other combinations of sockets hold by the driving unit 600 and the driving head 1000 may be ½" and ¾", 1" and ¾", or ⅜" and ½".

Although the present disclosure has been described in considerable detail with reference to certain embodiments thereof, other embodiments are possible. Therefore, their spirit and scope of the appended claims should no be limited to the description of these embodiments container herein.

It will be apparent to those skilled in the art that various modifications and variations can be made to the structure of the present disclosure without departing from the scope or spirit of the invention. In view of the foregoing, it is intended that the present disclosure cover modifications and variations of this invention provided they fall within the scope of the following claims.

What is claimed is:

1. A torque wrench, comprising:

a hollow body comprising a handle and an elongate sleeve partially inserted in the handle;

a clutch mechanism mounted in the hollow body;

a force-applying member pivotally mounted in the hollow body, wherein the force-applying member has a first end against the clutch mechanism and a second end opposing to the first end; and a plurality of interchangeable driving arms, each of interchangeable driving arms having a coupling end detachably mounted at the second end of the force-applying member and a driving end for driving a workpiece, wherein each of the interchangeable driving arms is coaxial to the force-applying member when the coupling end thereof is mounted at the second end of the force-applying member, and wherein the interchangeable driving arms are different in length from each other;

wherein a plurality of sets of scales are formed on the elongated sleeve each set of the scales corresponding to a separate one of the interchangeable driving arms and indicating a toque to be applied to the workpiece by said separate one of the interchangeable driving arms.

2. The torque wrench of claim 1, wherein the second end and the coupling end are bolted or engaged together.

3. The torque wrench of claim 1, wherein the clutch mechanism includes a spring, a load screw, and a plunger, the spring is compressed by the load screw and against the plunger, and the plunger is abutted against the first end.

4. The torque wrench of claim 1 wherein the driving end of each interchangeable driving arm has a fixed lateral drive extension or a detachable driving unit.

5. The torque wrench of claim 1, wherein each of the interchangeable driving arms is a plurality of rods detachably assembled with each other.

6. The torque wrench of claim 1, wherein a plurality of indications corresponding respectively to the interchangeable driving arms are formed on the elongate sleeve, each of the indications being provided adjacent to one of the sets of the scales and providing a discernible indication of which of the interchangeable driving arms corresponds to said one of the set of the scales.

7. A method of operating a torque wrench, comprising the steps of:

providing a torque wrench comprising a hollow body comprising a handle and an elongate sleeve partially inserted in the handle, a clutch mechanism mounted in the hollow body, a force-applying member pivotally mounted in the hollow body, wherein the force-applying member has a first end against the clutch mechanism and a second end opposing to the first end, and a plurality of interchangeable driving arms, each of interchangeable driving arms having a coupling end detachably mounted at the second end of the force-applying member and a driving end for driving a workpiece, wherein each of the interchangeable driving arms is coaxial to the force-applying member when the coupling end thereof is mounted at the second end of the force-applying member, and wherein the interchangeable driving arms are different in length from each other, wherein a plurality of sets of scales are formed on the elongated sleeve each set of the scales corresponding to a separate one of the interchangeable driving arms and indicating a toque to be applied to the workpiece by said separate one of the interchangeable driving arms;

mounting the clutch mechanism and the force-applying member in the hollow body;

mounting one of the interchangeable driving arms at the second end of the force-applying member, wherein the interchangeable driving arm mounted at the second end of the force-applying member is coaxial to the force-applying member; and driving the workpiece by taking the overall length of the force-applying member and the interchangeable driving arm mounted at the second end of the force-applying member as a first moment arm.

8. A torque wrench for holding a socket, comprising:

a hollow body comprising a handle and an elongate sleeve partially inserted in the handle;

a clutch mechanism mounted in the hollow body;

a force-applying member pivotally mounted in the hollow body, wherein the force-applying member has a first end against the clutch mechanism and a second end opposing to the first end; and a plurality of interchangeable driving arms, each of interchangeable driving arms having a coupling end detachably mounted at the second end of the force-applying member and a driving end for holding the socket, wherein each of the interchangeable driving arms is coaxial to the force-applying member when the coupling end thereof is mounted at the second end of the force-applying member, and wherein the interchangeable driving arms are different in length from each other;

wherein a plurality of sets of scales are formed on the elongated sleeve each set of the scales corresponding to a separate one of the interchangeable driving arms and indicating a toque to be applied to the workpiece by said separate one of the interchangeable driving arms.

9. A method of operating a torque wrench, comprising the steps of:

providing a torque wrench for holding a socket comprising a hollow body comprising a handle and an elongate sleeve partially inserted in the handle, a clutch mechanism mounted in the hollow body, a force-applying member pivotally mounted in the hollow body, wherein the force-applying member has a first end against the clutch mechanism and a second end opposing to the first end, and a plurality of interchangeable driving arms, each of interchangeable driving arms having a coupling end detachably mounted at the second end of the force-applying member and a driving end for holding the socket, wherein each of the interchangeable driving arms is coaxial to the force-applying member when the coupling end thereof is mounted at the second end of the force-applying member, and wherein the interchangeable driving arms are different in length from each other, wherein a plurality of sets of scales are formed on the elongated sleeve each set of the scales corresponding to a separate one of the interchangeable driving arms and indicating a toque to be applied to the workpiece by said separate one of the interchangeable driving arms;

mounting the clutch mechanism and the force-applying member in the hollow body;

mounting a driving unit at the second end of the force-applying member;

driving the workpiece by taking the length of the force-applying member as a second moment arm;

mounting one of the interchangeable driving arms at the driving unit, wherein the interchangeable driving arm mounted at the driving unit is coaxial to the force-applying member; and driving the workpiece by taking the overall length of the force-applying member, the driving unit and the interchangeable driving arm mounted at the driving unit as a third moment arm.

* * * * *